US005670076A

United States Patent [19]

Leek

[11] Patent Number: 5,670,076

[45] Date of Patent: Sep. 23, 1997

[54] REUSABLE COUPLER FOR FOUNDATION ANCHOR

[75] Inventor: William F. Leek, Anaheim, Calif.

[73] Assignee: Simpson Strong-Tie Company, Inc., Pleasanton, Calif.

[21] Appl. No.: 285,958

[22] Filed: Aug. 4, 1994

[51] Int. Cl.[6] ..... B29C 39/00

[52] U.S. Cl. ..... 249/53 M; 249/91; 249/93; 249/219.1; 52/698; 52/699; 52/700; 52/701; 52/702

[58] Field of Search ..... 249/53, 91, 93, 249/219.1; 52/698, 699, 700, 701, 702

[56] References Cited

U.S. PATENT DOCUMENTS

| | | | |
|---|---|---|---|
| 3,552,734 | 1/1971 | Severino | 249/93 |
| 4,340,200 | 7/1982 | Stegmeier | 249/3 |
| 4,641,478 | 2/1987 | Nelson, Jr. | 52/704 |
| 4,665,672 | 5/1987 | Commins et al. | 52/295 |
| 4,736,554 | 4/1988 | Tyler | 52/105 |
| 4,932,818 | 6/1990 | Garwood | 411/366 |
| 5,050,364 | 9/1991 | Johnson et al. | 52/705 |
| 5,240,224 | 8/1993 | Adams | 249/93 |
| 5,317,850 | 6/1994 | Colonias et al. | 52/293.3 |
| 5,337,534 | 8/1994 | Nasca | 52/745.21 |
| 5,388,804 | 2/1995 | Cohen et al. | 249/210 |

OTHER PUBLICATIONS

Copy from Official Patent Gazette Jun. 1, 1976 p. 196 PN: 3,960,356.

*Primary Examiner*—Christopher Kim
*Attorney, Agent, or Firm*—James R. Cypher

[57] ABSTRACT

A reusable coupler for accurately setting a threaded anchor in a concrete foundation to be poured having an attachment member for releasable attachment to a supporting structure and a tongue member that is formed with means for releasably gripping the threaded portion of the anchor. The releasable mechanical grip of the reusable coupler on the anchor is strong enough to insure that the orientation and the placement of the anchor will be maintained when the lower portion of the anchor is subjected to laterel forces during the concrete pour. The reusable coupler utilizes a one-piece design, wherein the mechanical gripping means works independantly from the attachment member. The reusable coupler can attach to a single form member for a concrete structure.

8 Claims, 6 Drawing Sheets

REUSABLE COUPLER FOR FOUNDATION ANCHOR

BACKGROUND

This invention relates to a means for accurately setting a threaded anchor in a concrete structure.

Anchors embedded in a concrete foundation that can threadably receive a bolt are commonly used in construction to attach wood or metal structural members to concrete structures. See U.S. Pat. No. 4,665,672, granted May 19, 1987. A primary use of the present invention is as an aid in forming the connection for securing wood frame structures to their concrete foundation. It is common practice in areas where earthquakes, floods, hurricanes and tornadoes subject buildings to uplift forces to make this attachment. The strength of the connection and its ability to withstand lateral and longitudinal forces is dependent on accurate positioning of the anchor. Anchors placed too close to the edge of the foundation may burst the side foundation at less than design loads and are more subject to corrosion. Anchors placed incorrectly must often be broken out of the concrete and reset. This can be time consuming, expensive and may decrease the ability of the anchor connection to withstand uplift forces. The invention disclosed allows a builder to accurately set and orient threaded anchors in concrete foundations in an economical manner.

It is common practice in the construction industry to suspend an anchor in a concrete foundation to be poured from a suspension means made from scrap lumber. An opening is drilled in the lumber and the anchor is inserted through the hole and held by a nut engaging its threaded end. Often, anchors are asymmetric, having a compound or lateral bend offset from the axis of the bolt defined by the threaded portion to provide mechanical resistance to pull-out. Orientation of this offset lower portion in relation to side faces of the concrete structure is important. One solution to maintaining the orientation of the anchor is to wire it to other structural members in the foundation.

Prior art reveals improvements on this process by teaching the use of pre-made suspension means and substitution of the nut for other means of holding the anchor. U.S. Pat. No. 3,960,356 teaches a pre-made suspension that can clampingly engage and support the anchor without the use of a nut, however, the pre-made suspension is limited to concrete structures formed by spaced-apart form boards of a dimension that the device can span. The device taught by U.S. Pat. No. 3,960,356 also relies only on friction to hold the anchor.

U.S. Pat. No. 4,932,818 teaches a threaded flange disposed on an anchor bolt next to the inner surface of a formwork template, cooperating with a threaded, closed-end sleeve which also has a flange on its inner end to firmly position the anchor in a perpendicular relation to the template. This method requires a formwork template or separate suspension member across the face of the concrete structure to be poured for suspending the anchor.

None of the devices disclosed benefit from a single-piece design and none address the importance of maintaining the orientation of the offset lower portion.

SUMMARY OF THE INVENTION

The present invention provides a simple reusable coupler to set an anchor at a select range of vertical and lateral positions relative to the supporting structure and any rotational position around the axis of the anchor in a concrete foundation that is to be poured.

An object of the present invention is to hold the anchor in relation to the foundation mechanically rather than by friction alone. The present invention also engages the anchor strongly enough to insure that the orientation of the embedded offset lower portion of the anchor in the concrete structure will be maintained during the concrete pour.

A further object of the present invention is that it is not limited to particular concrete forms. The reusable coupler need only attach to one supporting structure, such as a form board. Further, the mechanical gripping means is self-contained in the reusable coupler, functioning independently of the attachment member and the supporting member.

Ease of use is achieved over prior art by the one-piece design of the present invention. A further object of the preferred embodiment of the present invention is that common fasteners are used to attach the reusable coupler to an already present form member.

An additional feature of the present invention is the orientation indicia that aid the builder in properly orienting the anchor in the concrete structure. Proper orientation of the offset lower portion of the anchor provides increased pull-out resistance and reduces the possibility of corrosion of the anchor.

DESCRIPTION

Figure 1:
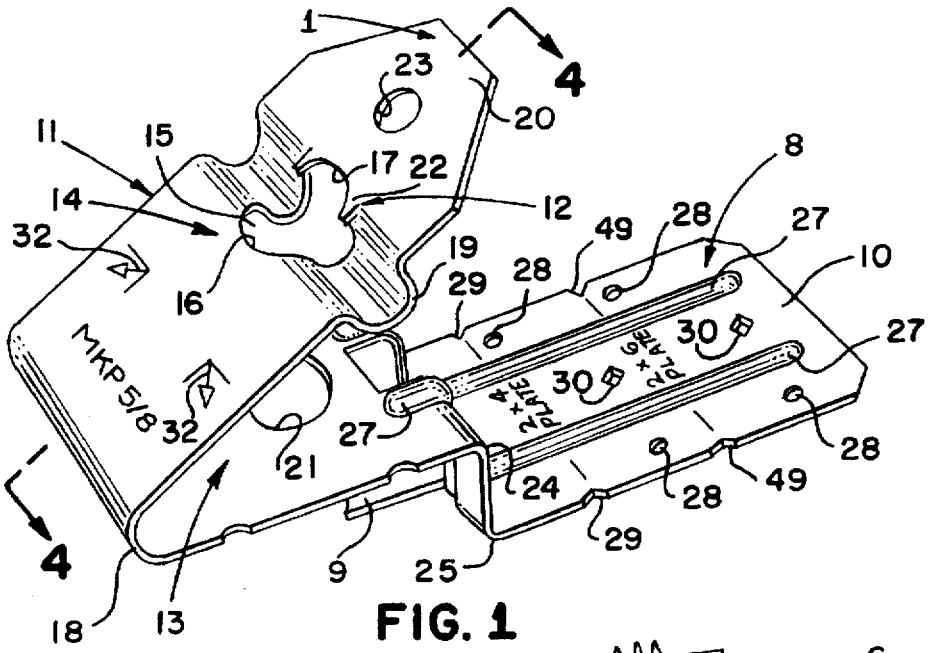
FIG. 1 is a perspective view of the reusable coupler of the present invention.
Figure 2:
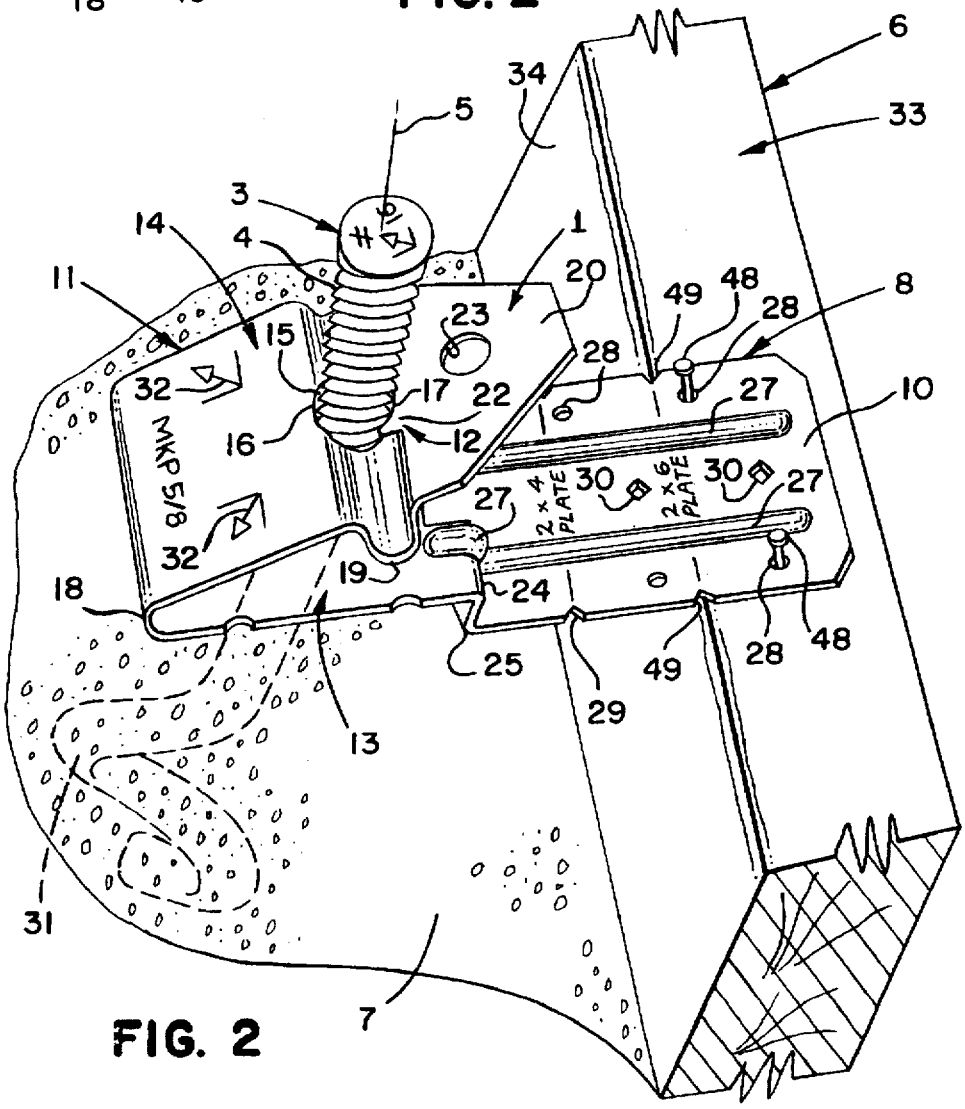
FIG. 2 is a perspective view of a typical use of the reusable coupler suspending an anchor in a concrete structure from a form member. The partially embedded lower portion of the anchor, designed with a compound curve, is shown with dashed lines.
Figure 3:
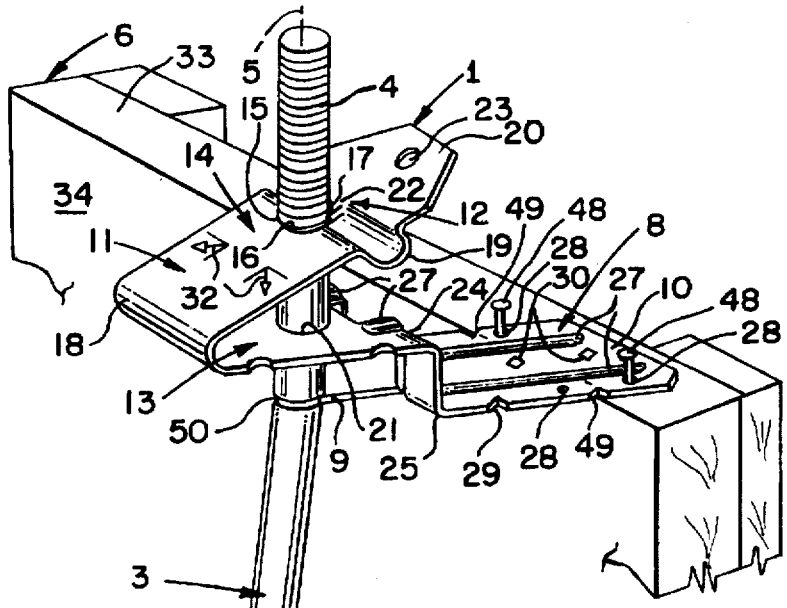
FIG. 3 is a perspective view of a typical use of the reusable coupler, prior to the pouring of the concrete structure.
Figure 4:
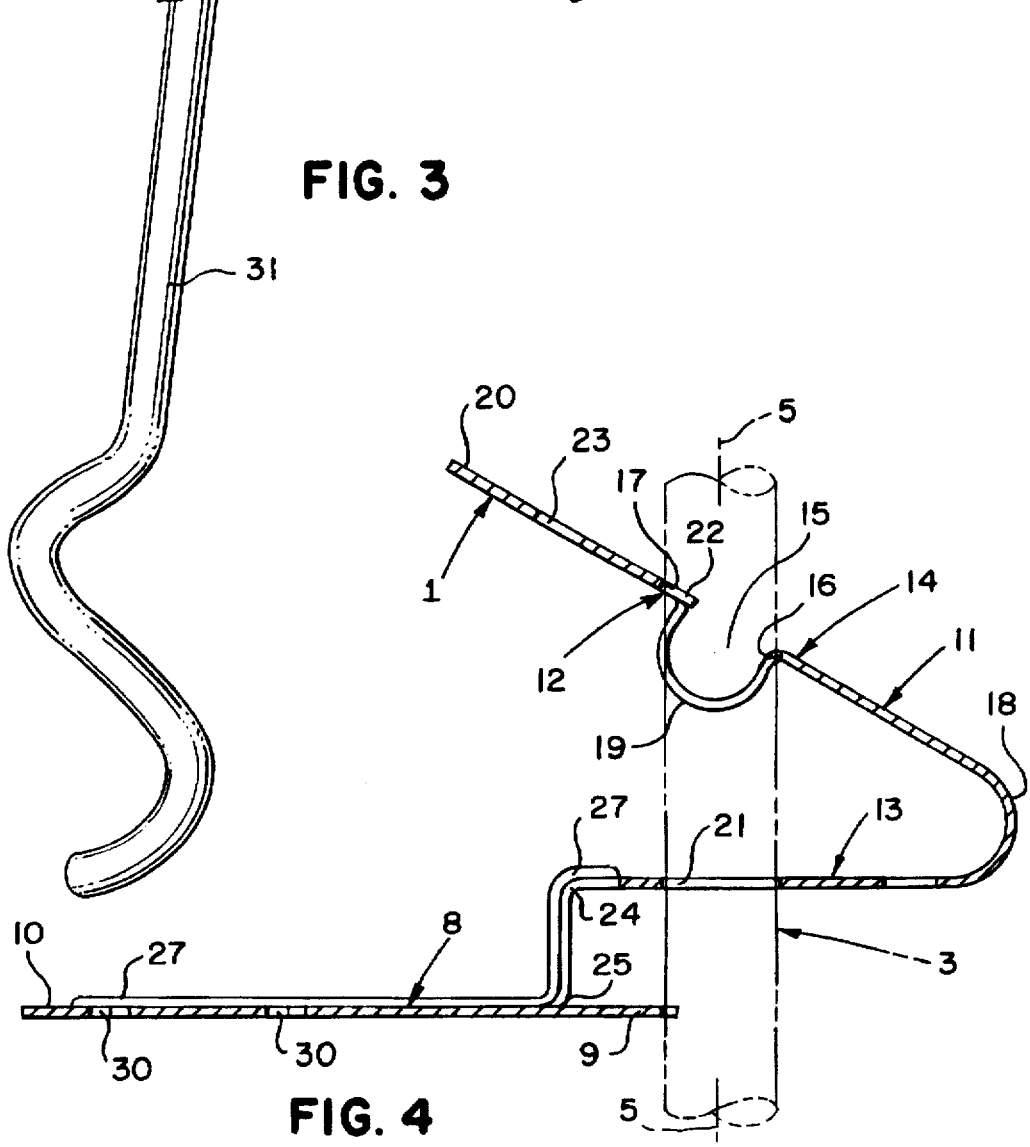
FIG. 4 is a side cross-sectional elevation view of the reusable coupler of the present invention taken along line 4—4 of FIG. 1. Dashed lines show the outline of a portion of an anchor engaged by the reusable coupler.

The present invention is a reusable coupler 1 for suspending an anchor 3 having a threaded portion 4 and an axis 5 from a supporting structure 6 in a concrete structure 7 that is to be poured, such that when the concrete structure 7 is poured and set, the anchor 3 will be accurately positioned in the concrete structure, including: an attachment member 8, having a brace member 9 to engage the anchor 3 and an end section 10 for removable attachment to the supporting structure 6; and a tongue member 11 flexibly and integrally connected to the attachment member 8, formed with means 12 for releasably gripping the threaded portion 4 of the anchor 3 along a select range of vertical and lateral positions relative to the supporting structure 6 and any rotational position around the axis 5 of the anchor 3.

The tongue member 11 includes: a bracing portion 13 adjacent to the attachment member 8 formed so that it receives and prevents the anchor 3 when received by the reusable coupler 1 from moving substantially in a direction along the length of the reusable coupler 1; a gripping portion 14 having a receiving opening 15 large enough to receive the threaded portion 4 of the anchor 3, where the receiving opening 15 has opposing edges 16 and 17 that cooperatively surround a portion of the threaded portion 4 of the anchor 3; a main longitudinal bend 18 between the bracing portion 13 and the gripping portion 14; a minor longitudinal bend 19, traversed by the receiving opening 15; and an end portion 20.

The main longitudinal bend 18 of the tongue member 11 allows the gripping portion 14 to receive the anchor 3 at an angle oblique to the axis 5 of the anchor 3 at the threaded portion 4 and allows for a selected amount of change in the angle between the bracing portion 13 and the gripping portion 14 due to the inherent flexibility of the material of the reusable coupler 1 such that there are a range of oblique angles at which the gripping portion 14 can receive the anchor 3, and such that when the main longitudinal bend 18 is in an unflexed first position the oblique angle at which the gripping portion 14 receives the anchor 3 allows the gripping portion 14 to hold the anchor 3 firmly, but when in a flexed second position the main longitudinal bend 18 is distorted such that the gripping portion 14 engages the anchor 3 at a more perpendicular angle to the axis 4 of the anchor 3 and the grip on the anchor 3 is less.

Figure 5:
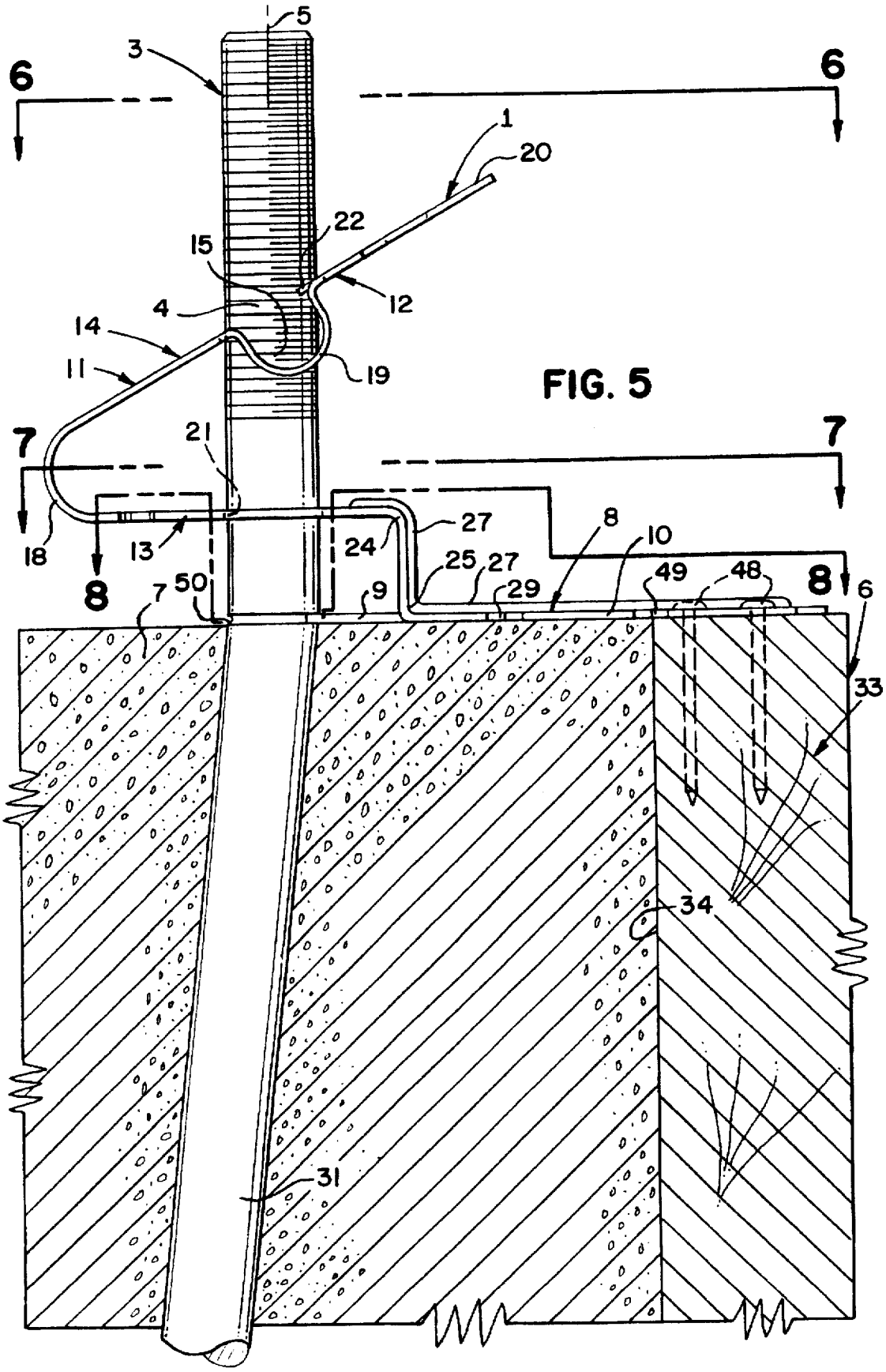
FIG. 5 is a side elevation view of the reusable coupler suspending an anchor in a concrete structure shown in cross section from a form member. Embedded fasteners in the form member are shown with dashed lines.

The minor longitudinal bend 19 provides a spring action that in the unflexed first position closes the distance between the opposing edges 16 and 17 such that the projected distance between them when the gripping portion is at the oblique angle as shown in FIG. 5 is less than the maximum diameter of the threads of the threaded portion 4 of the anchor 3, (see FIG. 6) and that in the flexed second position the minor longitudinal bend 19 is in tension which causes the projected distance to widen between the opposing edges 16 and 17, allowing the anchor to pass through the receiving opening 15. When the minor longitudinal bend 19 is in the unflexed first position and an anchor 3 has been inserted through the bracing opening 21 and the receiving opening 15, such that the gripping portion 14 engages the threaded portion 4 of the anchor 3, opposing edge 16 is inserted between threads of the anchor 3 and gripping edge 17 is inserted between the threads of the anchor 3 at the opposite side of the anchor 3, such that the anchor 3 is mechanically supported.

Preferably, the bracing portion 13 of the tongue member is formed with a bracing opening 21 which receives the anchor 3 and which prevents the anchor 3 from moving substantially from the axis 5 once it has been received by both the bracing opening 21 of the bracing portion 13 and the receiving opening 15 of the gripping portion 14.

In another preferred form, the gripping portion 14 is formed so that the opposing edges 16 and 17 of the receiving opening 15 substantially surround a portion of the threaded portion 4 of the anchor 3, and the edge of end portion 20 forming opposing edge 17 of the receiving opening 15 is formed as a tab 22 and juts into the receiving opening 15.

For ease of use, the gripping portion 14 of the tongue member 11 is formed with a second opening 23 in the end portion 20 which can receive a tool (not shown) for aiding in bending the tongue member 11 into the desired oblique angle.

In the preferred form of the invention, the attachment member 8 has a pair of longitudinal 90 degree bends 24 and 25 that offset the tongue member 11 from the end section 10 of the attachment member 8, stiffening the attachment member 8.

In the preferred form of the invention the brace member 9 of the attachment member 8 functions to prevent the anchor 3 from moving toward the supporting structure 6 past a selected point.

To increase the effective thickness of the attachment member 8 and its resistance to tension and bending forces, the attachment member 8 can be formed with a plurality of embossments 27 spaced along the width of the attachment member 8 that can extend partially onto the tongue member 11 and along a substantial portion of the end section 10. For ease of use the attachment member 8 is formed with openings 28 for receiving fasteners 48 to attach the reusable coupler 1 to the supporting structure 6.

Figure 6:
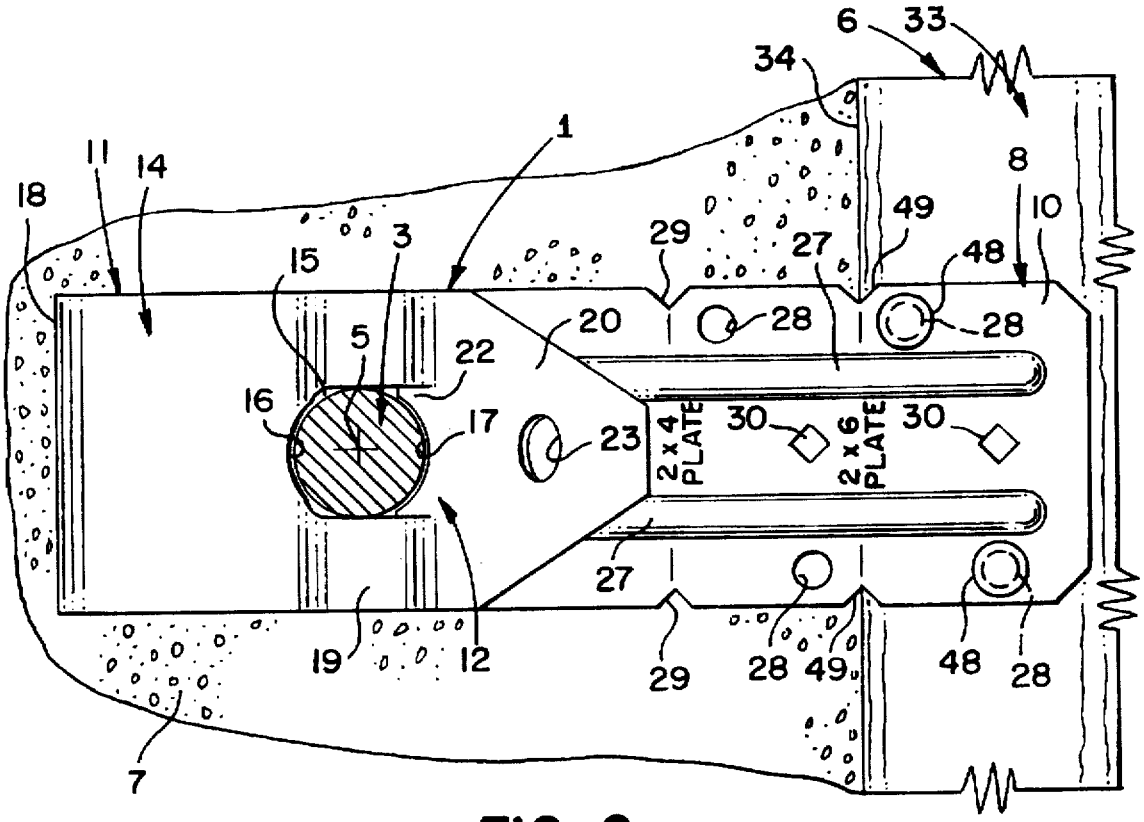
FIG. 6 is a top plan view of a typical use of the reusable coupler suspending an anchor in a concrete structure from a form member taken along line 6—6 of FIG. 5.
Figure 7:
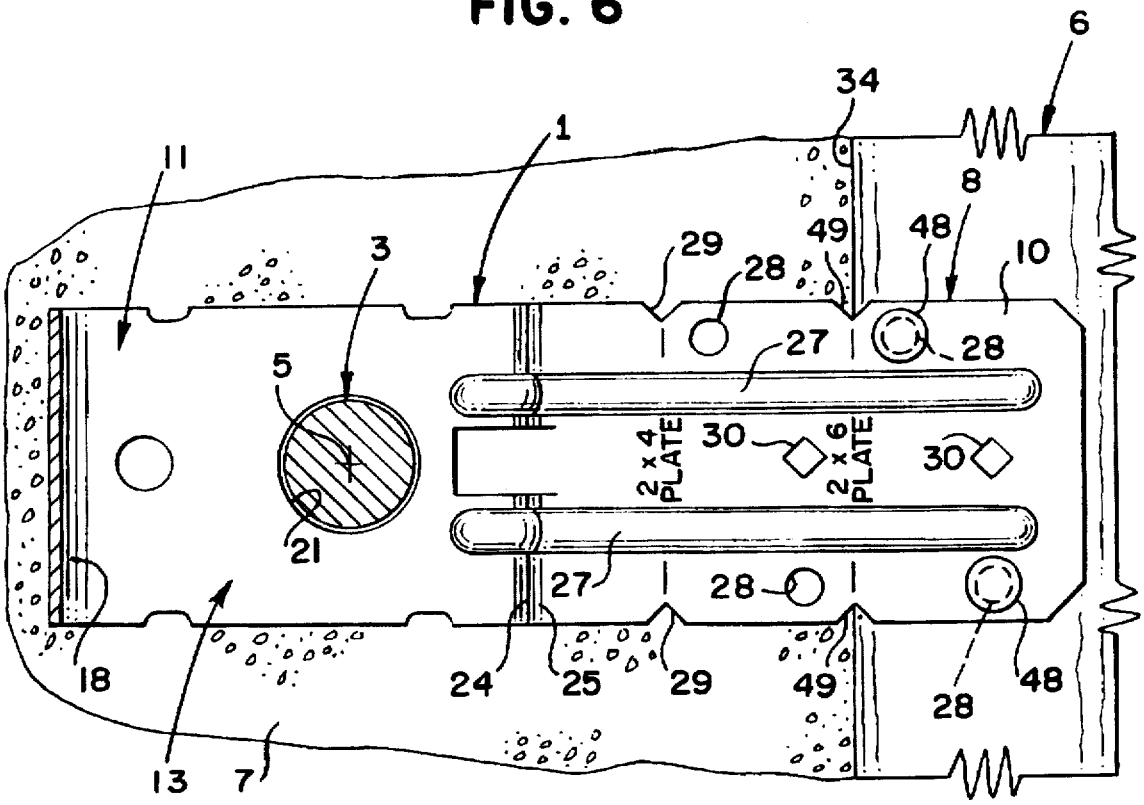
FIG. 7 is a top plan view partially in section illustrating a typical use of the reusable coupler suspending an anchor in a concrete structure from a form member taken along line 7—7 of FIG. 5.
Figure 8:
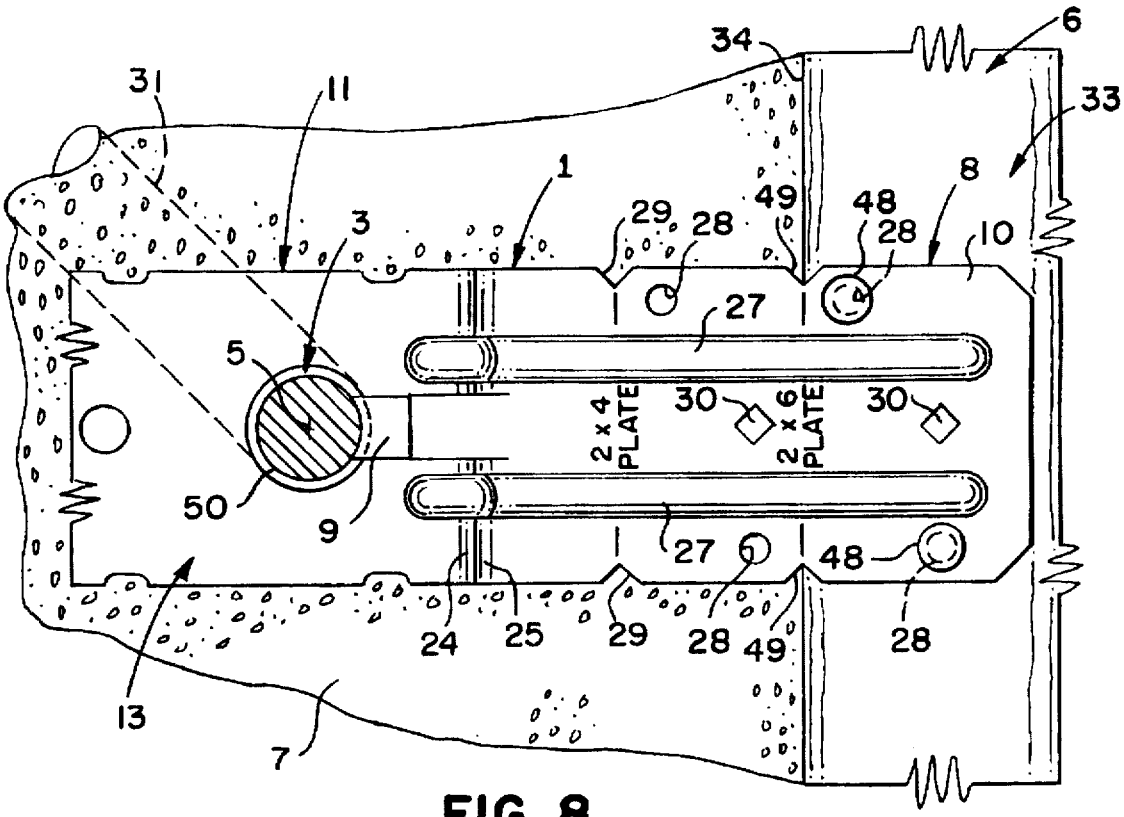
FIG. 8 is a top plan view partially in section illustrating a typical use of the reusable coupler suspending an anchor in a concrete structure from a form member taken along line 8—8 of FIG. 5. Dashed lines show a portion of the embedded anchor in the concrete structure.
Figure 9:
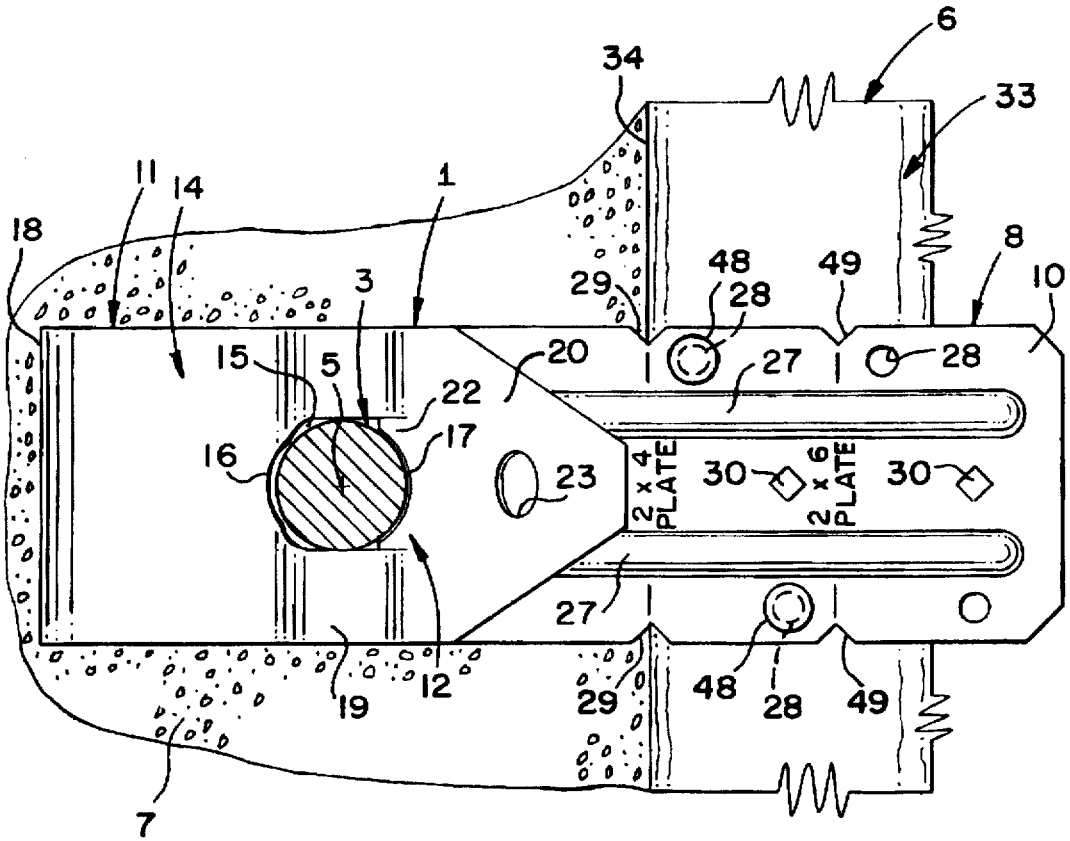
FIG. 9 is a top plan view of a typical use of the reusable coupler suspending an anchor in a concrete structure from a form member with the reusable coupler positioned on the form member for setting anchors to be used with a 2×4 mudsill.
Figures 10, 11, 12:
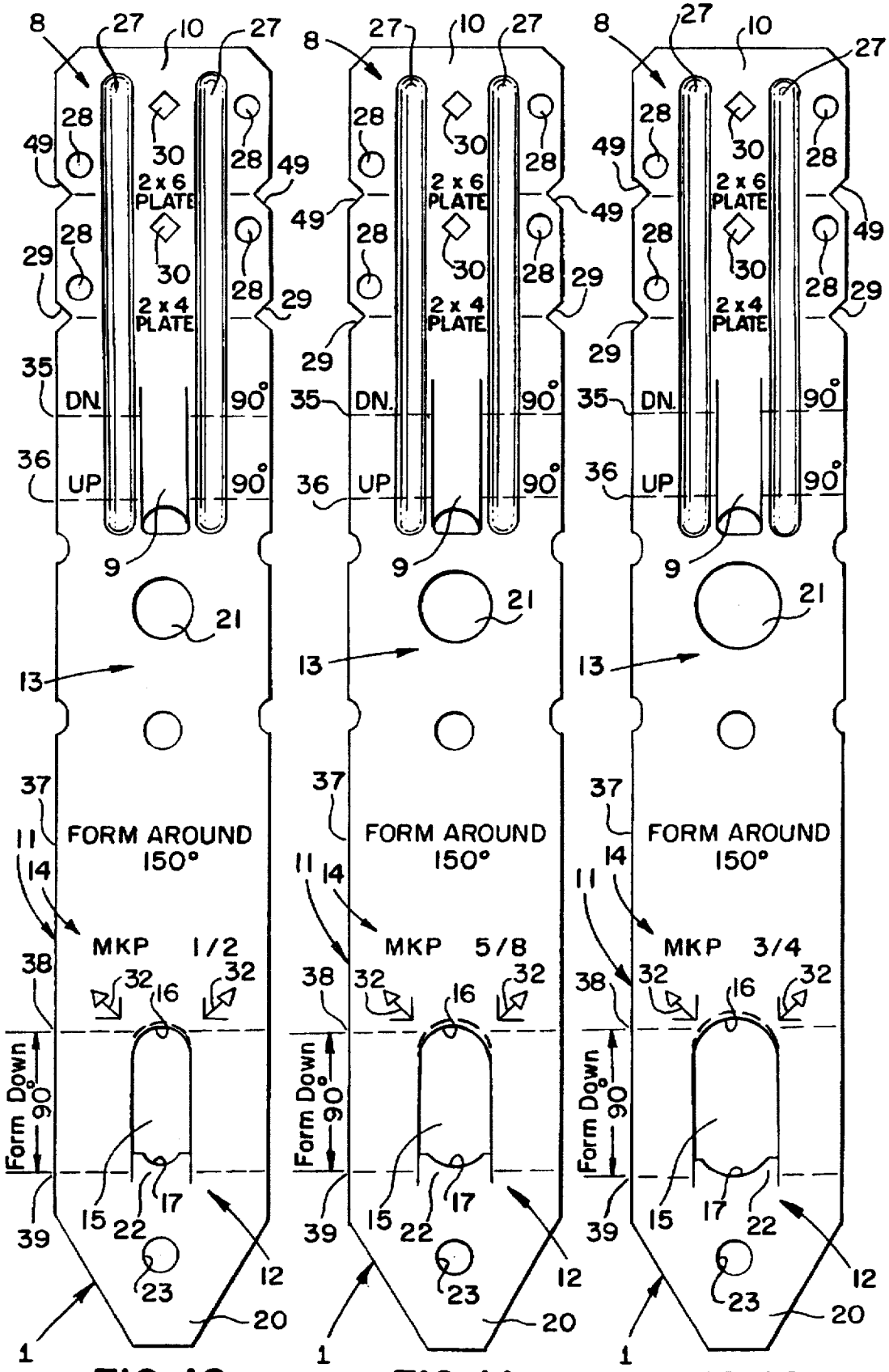
FIG. 10 is a top plan view of the blank of the reusable coupler prior to bending, designed to accommodate an anchor with a ½" threaded portion.
FIG. 11 is a top plan view of the blank of the reusable coupler prior to bending, designed to accommodate an anchor with a ⅝" threaded portion.
FIG. 12 is a top plan view of the blank of the reusable coupler prior to bending, designed to accommodate an anchor with a ¾" threaded portion.

As a further aid in installation, indicia means 29 and 49 in the form of notches on the sides of the end section 10 can be added to aid in positioning the reusable coupler 1 for setting anchors 3 at precise distances from the inner face 34 of supporting structure form member 33. FIG. 6 shows the reusable coupler 1 attached to a form member 33 for a concrete structure 7, using indicia means 49 for setting an anchor 3 in relation to form member inner face 34 in a structure having a 2×6 mudsill plate. FIG. 9 shows the reusable coupler 1 attached to a form member 33 for a concrete structure 7, using indicia means 29 for setting an anchor 3 in relation to form member inner face 34 to be used with a 2×4 mudsill plate. Indicia means showing a wide variety of selected lengths are possible.

Indicia means 30 can also be added to aid in positioning the reusable coupler 1 for setting anchors 3 at precise distances along a form member 33 of a concrete structure 7. FIG. 6 shows the indicia means 30 as rectangular openings in the end section 10. The diagonals of the rectangular openings 30 running longitudinal to the reusable coupler 1, intersect the axis 5 of an anchor 3 engaged by the reusable coupler 1. To position an anchor 3 in relation to a line drawn on the form member 33 generally perpendicular to the inner face 34 of the form member 33, the reusable coupler 1 is attached to the form member 33 with the drawn line bisecting the lateral diagonals of the rectangular openings 30.

Although not essential to the reusable coupler 1, to assist in the orientation of anchors 3 with offset lower portions 31 that protrude out from the axis 5 of the anchor 3 in one dimension, orientation indicia means 32, as shown in FIG. 1, can be formed on the reusable coupler 1 to show the preferred orientation of the lower portion 31 to a inner face 34 of the form member 33, when the reusable coupler 1 is positioned to jut at a ninety-degree angle from the inner face 34 of the form member 33. As taught in U.S. Pat. No. 5,317,850, the optimum orientation of the offset lower portion 31 of a common anchor 3 in a concrete structure 7 formed by two parallel, closely-spaced form members is at an angle 45 degrees to the inner faces 34 of the form members 33.

In the preferred form of the present invention, the reusable coupler 1 is formed from a sheet metal blank on a progressive die system. The inventor has engineered the preferred form of the invention such that reusable couplers formed from 16 gauge, galvanized steel can be adapted for a range of selected common anchors having an embedment length of 12" to 20" inches and selected thread diameters between ½" and ¾". Such reusable couplers when formed are approximately 1¾" wide, 5¾" long and 3¼" high. The bracing opening 21 and the receiving opening 15 are then formed to accommodate the dimensions of the selected anchor 3.

Construction of the reusable coupler 1 may be effected by reference to the blank shown in the drawings. Two bends are made in the attachment member 8. At bend line 35 the attachment member is sharply bent down 90 degrees. At bend line 36 the attachment member is sharply bent up 90 degrees. The minor longitudinal bend 19 is formed between form lines 38 and 39. The main longitudinal bend 18 is formed around form line 37 with a gentle 150 degree angle.

Use of the preferred embodiment of the invention is as follows. The reusable coupler 1 is first attached to the threaded portion 4 of a selected anchor 3 in the following manner. The threaded portion 4 of the anchor is inserted through the bracing opening 21 and then through the receiving opening 15 while tension is applied to the main longitudinal bend 18 and the minor longitudinal bend 21 by pinching the end portion 20 and the end section 10 toward each other, so that the distance between the gripping edges 16 and 17 allows passage of the threaded portion 4 of the anchor 3. The anchor 3 is inserted into the bracing opening 21 and the receiving opening 15 until the brace member 9 aligns with an elevation on the anchor 3 to which the anchor 3 will be embedded in the concrete structure 7. Where a Simpson Strong Tie SSTB anchor bolt is used (see U.S. Pat. No. 5,317,850) the brace member 9 is aligned with embedment indicia mark 50 on the anchor 3. Where an anchor 3 having an offset lower portion 31, such as the Simpson Strong Tie SSTB, is used, the anchor is rotated so that the offset lower portion of the anchor aligns with the orientation indicia means 32 of the reusable coupler 1. The reusable coupler 1 is then attached to form member 33, using the indicia means 29, 49 and 30 for positioning the anchor 3 at the proper distance from the form member 33 and laterally along the form member 33. The reusable coupler 1 should be attached with duplex nails for ease of removal from the form member 33.

After the concrete has been poured and cured, the reusable coupler 1 is removed. This is done by first removing the fasteners. Then the end portion 20 and the end section 10 are pinched toward each other to flex the main longitudinal bend 18 and the minor longitudinal bend 19 which disengages the gripping edges 16 and 17 from the threaded portion 4 of the anchor 3, allowing the reusable coupler 1 to be lifted off the embedded anchor 3.

It should also be noted that the reusable coupler 1 stabilizes the anchor 3 from lateral concrete pressure during the pour at three points.

I claim:

1. A reusable coupler for suspending an anchor having a threaded portion and a axis, said coupler comprising:

a. an attachment member including an end section adapted for removable attachment to a generally vertically form board supporting structure having an upper edge in a concrete structure that is to be poured to said upper edge of said generally vertical form board, such that when said concrete structure is poured and set, said anchor will be positioned in said concrete and all of said reusable coupler will be positioned above said concrete structure;

b. a tongue member flexibly and integrally connected to said attachment member, formed with means for releasably and mechanically gripping the threads of said threaded portion of said anchor, to hold said anchor along a select range of vertical and lateral positions relative to said supporting structure and any rotational position around said axis of said anchor;

c. a bracing portion integrally attached to said attachment member formed with a bracing opening which receives said anchor therethrough and which prevents said anchor from moving substantially from its axis once it has been received by both said bracing opening of said bracing portion and said receiving opening of said gripping portion;

d. a gripping portion having a receiving opening large enough to receive said threaded portion of said anchor therethrough, wherein said receiving opening has opposing edges that cooperatively surround portions of said threaded portion of said anchor;

e. a main longitudinal bend integrally connecting said bracing portion and said gripping portion; and f. said main longitudinal bend of said tongue member permits movement of said gripping portion to receive said anchor at an angle oblique to the axis of said anchor at said threaded portion and which allows for a selected amount of change in the angle between said bracing portion and said gripping portion due to the inherent flexibility of the material of said reusable coupler such that there are a range of oblique angles at which said gripping portion can receive said anchor, and such that when said main longitudinal bend is in an unflexed first position the oblique angle at which said gripping portion receives said anchor causes said opposing edges of said receiving opening to have a projected distance between them which is less than the maximum diameter of the threads on said threaded portion of said anchor thereby causing said gripping portion to hold said anchor firmly, but when in a flexed second position said main longitudinal bend is distorted such that said projected distance between said opening edges is greater than said maximum diameter of the threads on said threaded portion of said anchor thereby causing said gripping portion to be positioned relative to said anchor at a more perpendicular angle to the axis of said anchor and thereby releasing the grip on said anchor to permit free passage of said anchor through said receiving opening.

2. The reusable coupler as described in claim 1, comprising:

a. an end portion integrally connected to said gripping portion;

b. said opposing edges of said receiving opening substantially surround portions of said threaded portion of said anchor; and c. the edge closest to said end portion of said opposing edges of said receiving opening is formed as a tab and juts into said receiving opening.

3. The reusable coupler as described in claim 2, wherein said gripping portion of said tongue member includes a second opening in said end portion dimensioned to receive a tool for aiding in bending said tongue member into the desired oblique angle.

4. The reusable coupler as described in claim 1 wherein said attachment member has a pair of longitudinal bends that offset said tongue member from said end section of said attachment member.

5. The reusable coupler described in claim 1 wherein said end section of said attachment member has openings for receiving fasteners to attach said reusable coupler to said supporting structure.

6. The reusable coupler as described in claim 1 wherein:

a. said end section is formed with indicia means to aid in the positioning of said reusable coupler on said supporting structure so as to position said anchor at selected distances from said supporting structure; and b. said end section is formed with indicia means to aid in the positioning of said reusable coupler on said supporting structure so as to position said anchor at points designated on the supporting structure.

7. A reusable coupler for suspending an anchor having a threaded portion and an axis, said coupler comprising:

a. an attachment member including an end section adapted for removable attachment to a generally vertical form board supporting structure having an upper edge in a concrete structure that is to be poured to said upper edge of said generally vertical form board, such that when said concrete structure is poured and set, said anchor will be positioned in said concrete and all of said reusable coupler will be positioned above said concrete structure;

b. a tongue member flexibly and integrally connected to said attachment member, formed with means for releasably and mechanically gripping the threads of said threaded portion of said anchor, to hold said anchor along a select range of vertical and lateral positions relative to said supporting structure and any rotational position around said axis of said anchor;

c. a bracing portion integrally attached to said attachment member formed with a bracing opening which receives said anchor therethrough and which prevents said anchor from moving substantially from its axis once it has been received by both said bracing opening of said bracing portion and said receiving opening of said gripping portion;

d. a gripping portion having a receiving opening large enough to receive said threaded portion of said anchor therethrough, wherein said receiving opening has opposing edges that cooperatively surround portions of said threaded portion of said anchor;

e. a main longitudinal bend integrally connecting said bracing portion and said gripping portion and positioning said bracing portion and said gripping portion at an acute angle relative to one another;

f. a minor longitudinal bend formed in said gripping portion and traversed by said receiving opening; and g. said main longitudinal bend of said tongue member is adapted to position said gripping portion to receive said anchor at an angle oblique to the axis of said anchor at said threaded portion such that when said main longitudinal bend is in an unflexed first position the oblique angle at which said gripping portion receives said anchor causes said opposing edges of said receiving opening to have a projected distance between them which is less than the maximum diameter of the threads on said threaded portion of said anchor thereby causing said gripping portion to hold said anchor firmly; and h. said minor longitudinal bend provides a spring action that in an unflexed first position closes the distance between said opposing edges such that said distance is less than the maximum diameter of the threads of said threaded portion of said anchor at said oblique angle which causes the gripping portion to engage said anchor, and in a flexed second position said minor longitudinal bend is in tension which causes the distance to widen between said opposing edges, allowing said anchor to pass through said receiving opening and when in said flexed second position said minor longitudinal bend is distorted such that said projected distance between said opening edges is greater than said maximum diameter of the threads on said threaded portion of said anchor.

8. A reusable coupler for suspending an anchor having a threaded portion and an axis, said coupler comprising:

a. an attachment member including an end section adapted for removable attachment to a generally vertical form board supporting structure having an upper edge in a concrete structure that is to be poured to said upper edge of said generally vertical form board, such that when said concrete structure is poured and set, said anchor will be positioned in said concrete and all of said reusable coupler will be positioned above said concrete structure;

b. a tongue member flexibly and integrally connected to said attachment member, formed with means for releasably and mechanically gripping the threads of said threaded portion of said anchor, to hold said anchor along a select range of vertical and lateral positions relative to said supporting structure and any rotational position around said axis of said anchor;

c. a bracing portion integrally attached to said attachment member formed with a bracing opening which receives said anchor therethrough and which prevents said anchor from moving substantially from its axis once it has been received by both said bracing opening of said bracing portion and said receiving opening of said gripping portion;

d. a gripping portion having a receiving opening large enough to receive said threaded portion of said anchor therethrough, wherein said receiving opening has opposing edges that cooperatively surround portions of said threaded portion of said anchor;

e. a main longitudinal bend integrally connecting said bracing portion and said gripping portion;

f. said main longitudinal bend of said tongue member permits movement of said gripping portion to receive said anchor at an angle oblique to the axis of said anchor at said threaded portion and which allows for a selected amount of change in the angle between said bracing portion and said gripping portion due to the inherent flexibility of the material of said reusable coupler such that there are a range of oblique angles at which said gripping portion can receive said anchor, and such that when said main longitudinal bend is in an unflexed first position the oblique angle at which said gripping portion receives said anchor causes said opposing edges of said receiving opening to have a projected distance between them which is less than the maximum diameter of the threads on said threaded portion of said anchor thereby causing said gripping portion to hold said anchor firmly, but when in a flexed second position said main longitudinal bend is distorted such that said projected distance between said opening edges is greater than said maximum diameter of the threads on said threaded portion of said anchor thereby causing said gripping portion to be positioned relative to said anchor at a more perpendicular angle to the axis of said anchor thereby releasing the grip on said threaded portion of said anchor to permit free passage of said anchor through said receiving opening;

g. a minor longitudinal bend formed in said gripping portion and traversed by said receiving opening; and h. said minor longitudinal bend provides a spring action that in an unflexed first position closes the distance between said opposing edges such that said distance is less than the maximum diameter of the threads of said threaded portion of said anchor at said oblique angle when said main longitudinal bend is in said unflexed first position which causes the gripping portion to engage said anchor, and in a flexed second position said minor longitudinal bend is in tension which causes the distance to widen between said opposing edges in cooperation with the flexing of said main longitudinal bend allowing said anchor to pass through said receiving opening and when in said flexed second position said minor longitudinal bend is distorted such that said projected distance between said opening edges is greater than said maximum diameter of the threads on said threaded portion of said anchor.

* * * * *